US006283332B1

(12) United States Patent
Ragno

(10) Patent No.: US 6,283,332 B1
(45) Date of Patent: Sep. 4, 2001

(54) FLUID SUBSTANCE DISPENSER WITH EASILY DISENGAGABLE SNAP-LOCKING ELEMENTS

(75) Inventor: Antonino Ragno, Milan (IT)

(73) Assignee: Lumson S.p.A., Capergnanica (IT)

( * ) Notice: Subject to any disclaimer, the term of this patent is extended or adjusted under 35 U.S.C. 154(b) by 0 days.

(21) Appl. No.: 09/493,015

(22) Filed: Jan. 28, 2000

(30) Foreign Application Priority Data

Jan. 29, 1999 (IT) ..... MI99A0171

(51) Int. Cl.[7] ..... B67D 5/00
(52) U.S. Cl. ..... 222/153.13; 222/384
(58) Field of Search ..... 222/153.13, 384, 222/402.13

(56) References Cited

U.S. PATENT DOCUMENTS 3,229,863 * 1/1966 Scoggin, Jr. et al. ..... 222/153.13
4,065,036 * 12/1977 Kirk, Jr. ..... 222/153.13
4,496,082 * 1/1985 Corsette ..... 222/153.13
4,566,611 * 1/1986 Sukopp ..... 222/153.13
4,589,573 * 5/1986 Tada ..... 222/153.13
4,589,574 * 5/1986 Foster ..... 222/153.13
5,558,258 9/1996 Albini et al. .
5,779,106 7/1998 Albini et al. .
5,842,616 12/1998 Ruscitti et al. .

* cited by examiner

*Primary Examiner*—Philippe Derakshani
*Assistant Examiner*—Thach H Bui
(74) *Attorney, Agent, or Firm*—Oblon, Spivak, McClelland, Maier & Neustadt, P.C.

(57) ABSTRACT

A fluid substance dispenser includes a dispensing head or pusher to be fitted onto the stem of a pump. The fluid substance dispenser also includes a cap to be fixed onto the mouth of a container containing the substance to be dispensed. On the outer surface of the head and on the inner surface of the cap, spiral ribs are provided which extend in the same direction. The spiral ribs interfere with each other and pass snapwise over each other, when the head is pressed onto the cap. The spiral ribs cooperating "with each other" to cause the head to withdraw from the cap, when the head is rotated about the cap.

3 Claims, 1 Drawing Sheet

FLUID SUBSTANCE DISPENSER WITH EASILY DISENGAGABLE SNAP-LOCKING ELEMENTS

BACKGROUND OF THE INVENTION

Field of the Invention

The present invention relates to a pressurized fluid substance dispenser with elements for snap-locking the dispensing head when in its lowered position.

DISCUSSION OF BACKGROUND

Fluid substances (liquids or creams) are commonly dispensed under pressure by pumps mounted on the mouth of containers containing the substance to be dispensed. The pressurized fluid is discharged to the outside by passing through cavities provided in a dispensing head or pusher, which has been press-fitted onto the free end of the pump stem.

The delivery pump and head occupy when at rest a relatively large space in their length direction. However, this is, in many cases, a serious drawback. Hence, various systems have been designed and used for locking the head on the respective pump during storage, packaging and transport, and for preventing delivery of the substance, if the head is accidentally pressed towards the respective pump.

This is achieved, by fixing onto the mouth of each container (on which a pump is mounted), a cap provided with elements which cooperate with corresponding elements provided on the delivery head, to retain this head, when lowered onto the cap.

As this head lowering operation is carried out in industrial plants operating at high speed, the delivery head has to be able to be engaged and retained automatically by the respective cap, whatever the angular position of the head relative to the cap.

The most simple engagement system is the snap type, such as that described in U.S.Pat No. 4,368,830 and in EP-A-0065214 and EP-A-0686432, which show a rib projecting inwardly from the upper free edge (i.e., the edge facing the outside of the pump) of the cap to snap-engage a corresponding rib or tooth projecting outwardly from the lower free edge of the respective delivery head.

The head is disengaged from the respective cap (to return the head to its raised position, in which it is operable) by different methods in the three above-mentioned patents, but always with certain difficulties which it would be desirable to overcome.

In the case of U.S. Pat. No. 4,368,830, to disengage the head 18 from the cap 13, the tab 24, projecting from the head 10 must be pressed laterally with a finger to bend the tab inwardly and to release the profiled tooth 27, projecting from the tab, 24 from the annular rib 21, projecting from the cap 13. It is immediately apparent that releasing the head 18 from the cap 13 is not easy to achieve, and moreover, the structure of the head 18 makes it very costly because the tab 24 is connected to the lateral wall 25 of the head at its lower end, which can be achieved only by using very complicated and costly molds of low productivity.

In the case of EP-A-0065214, the dispenser is locked in its lowered position by an endless annular rib 18, projecting outwardly from the lower end of the head, engaging and being retained by a plurality of annular rib segments 19 projecting inwardly from respective flexible appendices 17 on the cap. A serious drawback of this system is that to release the head from the cap, the head must be pulled, in the sense of withdrawing it from the cap. Initially, there is a strong resistance to this withdrawal (because the ribs 19 retain the rib 18), then the rib 18 suddenly (rather than gradually) overcomes the rib 19, such that the head (which is being pulled to release it from the cap) may be pulled completely away from the end of the stem of the pump on which it is mounted.

EP-A-0686432 describes a dispenser in which, when in its lowered position, the head 1 is locked to the cap 2 buy the engagement between a tooth 17, projecting from the head 1 and an annular rib 7, projecting from the cap. The tooth 17 projects from a flexible tab 13, which is formed by making two distinct longitudinal cuts to separate the tab from the remaining portion of the cylindrical skirt 11, which forms a forming part of the head 1. Forming the two longitudinal cuts 12 at the same time as the tooth 17, which projects laterally from the tab 13, requires the use of molds of complex structure with relatively bulky components, able to operate only at relatively low speed, with the result that the head cost is rather high.

SUMMARY OF THE INVENTION

The main object of the present invention is to provide a fluid substance dispenser comprising elements which enable it to be snap-locked, when in its lowered position, whatever the angular position of the head relative to the cap, while enabling the head to be freely rotated about the cap, to which it is locked, when in its lowered position, and in particular, which can be produced by molds of relatively simple structure to minimize their cost, but which is very easy to move from the lowered position, in which the head is locked to the cap, to the operational position, in which the head is free and released from the cap.

This and still further objects are attained by a fluid substance dispenser including a cap and a delivery head. The cap is provided with means for fixing it onto the mouth of a container containing a substance to be delivered by a pump mounted on the container's mouth. The head has a seat for housing the free end of the stem of the pump. The seat communicates with a substance discharge hole. A substantially cylindrical skirt projects from the cap. A substantially cylindrical skirt which forms a part of the head can be inserted into the cap skirt to be movable longitudinally therein. At least one profiled rib projects from the inner surface of the cap skirt and is engagable by a corresponding profiled rib projecting outwardly from the head skirt to retain the head in a lowered position, when the head skirt is inserted into a space bounded by the cap skirt. The ribs projecting from the cap skirt and from the head skirt are spiral ribs having at least one start which wind in the same direction on both the cap and the head. The ribs extend for a limited portion of the length of the respective skirt. The cap skirt is dimensioned and shaped so as to define, below the ribs projecting from it, and towards that end on which the fixing means are provided, a free space in which the rib projecting from the head skirt can be housed and can freely rotate. The ribs are shaped so as to be able to be snapped into engagement when the head is pressed from a free operational position to the lowered position wherein it is locked to the cap. The ribs projecting from the head skirt are able to engage the ribs of the cap skirt to enable the head to be unscrewed from the cap so that the ribs are disengaged from each other to free the head from the cap.

BRIEF DESCRIPTION OF THE DRAWINGS

The structure and characteristics of the dispenser of the present invention will be more apparent from the description of a preferred embodiment thereof given hereinafter by way of non-limiting example with reference to the accompanying drawing, in which.

DETAILED DESCRIPTION OF THE PREFERRED EMBODIMENTS

Figure 1:
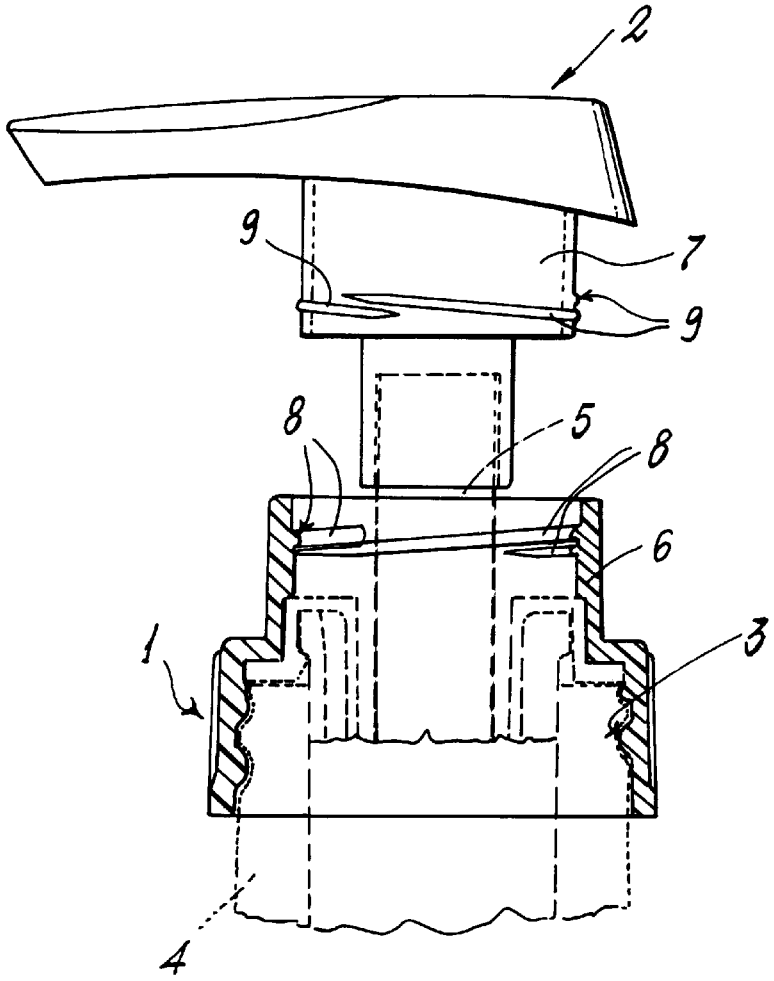
FIG. 1 is a partical/cross-sectional view of the dispenser shown in its free operational position.

The dispenser is formed from two component parts, namely a cap 1 and a delivery head 2.

The cap is provided with means (for example, an annular rib 3) which enable it to be fixed on the mouth or neck 4 of a container carrying a pump of any known type. A stem 5 of the pump extends into and beyond the space bounded by a cylindrical cap skirt 6 forming part of the cap 1.

A cylindrical head skirt 7 projects from the delivery head 2, when the dispenser has been mounted (as shown in the figures) on the mouth or neck 4 of the container containing the substance to be dispensed. The cylindrical head skirt 7 is coaxial with the stem 5 of the pump mounted on the container mouth or neck 4.

The head skirt 7 is shaped and dimensioned such as to enable it to penetrate into and rotate within the space bounded by the cap skirt 6.

A multi-start spiral rib 8, clearly visible in FIG. 1, projects from the inner surface of the skirt 6 in proximity to its free edge.

A spiral rib 9 extending in the same direction as the rib 8 also projects from the outer surface of the head skirt 7 in proximity to its free edge.

The ribs 8 and 9 are shaped and dimensioned such that when the head 2 is pressed towards the cap 1 (to pass from its free operational position of FIG. 1 to its lowered locked position of FIG. 2), the ribs 9 pass beyond the ribs 8 snapwise without interfering with them.

When the head skirt 7 is positioned within the space bounded by the cap skirt 6 (FIG. 2), with the ribs 9 lying below (with respect to the figures) the ribs 8, the ribs 9 are urged against the ribs 8 by the spring forming part (not shown) of the pump on the stem 5 of which the head 2 is mounted. However the head is retained securely in the lowered position because the ribs 8 have only their upper surface inclined downwardly, this to enable them to be easily passed over by the ribs 9 in passing from the position of FIG. 1 to the position of FIG. 2.

Figure 2:
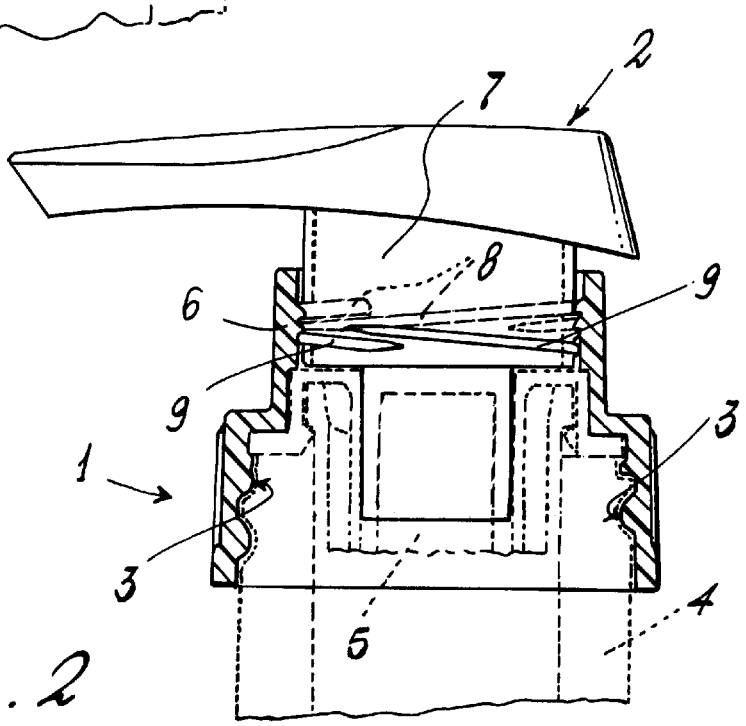
FIG. 2 shows the same dispenser in its locked position.

It is essential that below the ribs 8, the cap skirt 6 defines a free space within which the ribs 9 of the head skirt 7 of the head 2 can be positioned and freely housed, as shown in FIG. 2. When in this position, the head 2 is securely retained in the lowered position, in which the head can be freely rotated in one direction about the cap (essential for packaging, if the head 2 is of elongate or irregular shape) because the ribs 8 and 9 have the same development, whereas if the head 2 is rotated in the opposite direction to the preceding, the ribs 9 engage the ribs 8 to hence cause the head to "unscrew" on the cap. This unscrewing is very easy to achieve, to return the head 2 to its operational position of FIG. 1.

The head 2 and cap 1 are of very simple structure, so that they can be produced using simple molds of relatively low cost which can operate at high speed, so that the cost of the dispenser produced with these molds is low.

What is claimed is:

1. A fluid substance dispenser comprising:

a cap including means for fixing said cap onto a mouth of a container containing a substance to be delivered by a pump mounted on the mouth;

a delivery head having a seat for housing a free end of a stem of said pump, said seat communicating with a substance discharge hole;

a substantially cylindrical cap skirt projecting outwardly from an outer surface of said cap;

a substantially cylindrical head skirt, which forms a part of said head, inserted into said cap skirt to be movable longitudinally therein;

at least one profiled rib projecting radially outwardly from an inner surface of said cap skirt to friction fit against a corresponding profiled rib projecting outwardly from said head skirt to retain said head in a lowered position in which said head skirt is inserted into a space bounded by said cap skirt, wherein said ribs projecting from said cap skirt and from said head skirt are spiral ribs having at least one start which wind in a same direction on both said cap and said head and extend for a limited portion of a length of said cap skirt and said head skirt, respectively, said cap skirt being dimensioned and shaped so as to define, below the ribs projecting from therefrom and towards an end on which said fixing means are provided, a free space in which said rib projecting from said head skirt is housed and freely rotates when said head is in said lowered position, said ribs projecting from said head skirt and said cap skirt being shaped so as to be snapped past each other when said head is pressed from a free operational position to said lowered position wherein said head is locked to the cap, said rib projecting from said head skirt being able to engage said rib of said cap skirt to enable said head to be unscrewed from said cap until said ribs projecting from said head skirt and said cap skirt are disengaged from each other to free said head from said cap.

2. The dispenser as claimed in claim 1, wherein said spiral ribs are of more than one start.

3. The dispenser as claimed in any one claims 1 or 2, wherein an upper surface of said spiral rib projecting from said cap is inclined downwardly.

* * * * *